US007383834B2

(12) United States Patent
Budd

(10) Patent No.: US 7,383,834 B2
(45) Date of Patent: Jun. 10, 2008

(54) COMPOUND BOW WITH IMPROVED RISER

(75) Inventor: David R Budd, Middleville, MI (US)

(73) Assignee: Production Solutions, Inc., Middleville, MI (US)

( * ) Notice: Subject to any disclaimer, the term of this patent is extended or adjusted under 35 U.S.C. 154(b) by 0 days.

(21) Appl. No.: 11/410,813

(22) Filed: Apr. 25, 2006

(65) Prior Publication Data

US 2007/0246032 A1 Oct. 25, 2007

(51) Int. Cl.
*F41B 5/10* (2006.01)
*F41B 5/20* (2006.01)

(52) U.S. Cl. ..... 124/88; 124/25.6; 124/89

(58) Field of Classification Search ..... 124/23.1, 124/25.6, 86, 88, 89; 473/578
See application file for complete search history.

(56) References Cited

U.S. PATENT DOCUMENTS

| | | | | |
|---|---|---|---|---|
| 4,693,230 | A * | 9/1987 | Sugouchi | 124/88 |
| 4,836,964 | A | 6/1989 | Tsai | 264/46.7 |
| 5,269,284 | A | 12/1993 | Pujos et al. | 124/88 |
| 5,295,692 | A * | 3/1994 | Wright | 473/578 |
| 5,335,644 | A | 8/1994 | Smith et al. | 124/23.1 |
| 5,362,046 | A | 11/1994 | Sims | 273/73 |
| 5,365,650 | A | 11/1994 | Smith et al. | 29/417 |
| 5,595,168 | A | 1/1997 | Martin | 124/89 |
| 5,816,233 | A | 10/1998 | Andrews | 124/86 |
| 5,881,704 | A * | 3/1999 | Andrews | 124/23.1 |
| 2005/0229912 | A1 * | 10/2005 | Pilpel et al. | 124/86 |
| 2005/0260394 | A1 | 11/2005 | Ajbani et al. | 428/217 |
| 2007/0007689 | A1 * | 1/2007 | Pilpel | 264/239 |
| 2007/0157916 | A1 * | 7/2007 | Mancini | 124/89 |
| 2007/0193567 | A1 * | 8/2007 | D'Acquisto | 124/23.1 |

* cited by examiner

*Primary Examiner*—John A. Ricci
(74) *Attorney, Agent, or Firm*—Van Dyke, Gardner, Linn & Burkhart, LLP

(57) ABSTRACT

A compound bow includes a base member with a longitudinal extent and has first and second ends. The base member is formed from a rigid material and has a grip location between its first and second ends, which provide mounting locations for mounting limbs to the base member. An elastomeric body is applied over, for example by molding, and at least substantially encapsulates the base member over the longitudinal extent. The elastomeric body comprises an elastomeric material, and optionally forms a grip member at the grip portion.

24 Claims, 3 Drawing Sheets

COMPOUND BOW WITH IMPROVED RISER

TECHNICAL FIELD AND BACKGROUND OF THE INVENTION

The present invention generally relates to a bow and, more particularly, to a compound bow that exhibits improved vibration dampening and generates less noise than conventional bows.

Bows typically have four main components: a riser or handle; two arms or limbs that mount to the riser; and a bow string or cable that is tensioned between the two arms. In the past, the riser was made from wood, but more recently risers are formed from metals, such as cast aluminum or magnesium. Even more recently, the risers have been formed from extruded metals, such as extruded aluminum. While metal risers have provided increased stiffness and, in some cases, reduced the weight of the bow, they have exhibited increased vibration and, more significantly, generate louder and higher frequency noise when the riser makes contact with an object, such as an arrow, tree, or tree stand, when the riser is bumped into the object or the object bumps into the riser. These risers even tend to produce more noise during a release cycle. Noise is particularly undesirable when a hunter is approaching his or her prey.

While vibration dampeners have been proposed to reduced noise when the bow string is pulled and then released, heretofore these vibration dampeners have not succeeded in reducing the other noises inherent when handling a bow.

Accordingly, there is a need for a bow that will exhibit increased vibration dampening and further will minimize noise that is inherent when using or handling the bow.

SUMMARY OF THE INVENTION

Accordingly, the present invention provides a bow that produces less noise when used and also when handled.

In one form of the invention, a compound bow includes a base member, which is formed from a rigid material and has a grip location between the two ends of the base member, which provide mounting locations for mounting limbs to the base member. An elastomeric body is applied over and at least substantially encapsulates the base member over the longitudinal extent of the base member, with the elastomeric body comprising a dampening material and, further, forming a grip member at the grip portion.

In one aspect, the base member is formed from an extruded material, such as extruded aluminum or magnesium.

In other aspects, the elastomeric body is formed from two materials with one of the materials forming the grip member and having a different durometer value than the other material.

In yet another aspect, the bow includes two limbs mounted to the opposed ends of the base member with the dampening material applied over at least a portion of each of the limbs.

According to another aspect, the dampening material may be applied to at least a portion of at least one of the ends of the base member. For example, at least one of the ends may include at least one recess, with the dampening material extending into the recess.

In other aspects, the base member includes at least one mounting opening at the grip location for mounting a separate grip member to the base member, with the elastomeric body being applied over the opening but being removable wherein the separate grip member may be mounted to the base member at the mounting opening in place of the grip member formed by the elastomeric body. Optionally, the elastomeric body has an indication around the grip location to provide a cutting guide for a user to cut and remove the dampening material around the grip location.

In yet further aspects, the elastomeric body terminates at the ends wherein the ends of the base member are free of the elastomeric body.

Further, the base member may include at least one lightening opening, with the elastomeric body at least partially extended into the lightening opening.

In another form of the invention, a compound bow includes a base member, which is formed from a rigid material and has a grip location between its ends, which provide mounting locations for mounting limbs to the base member. The grip location has at least one mounting opening for mounting a separate grip member to the base member. In addition, an elastomeric body is applied over and at least substantially encapsulates the base member over its longitudinal extent and covers the mounting opening but is removable at least at the mounting opening. The elastomeric body comprises a dampening material and may have a durometer in a range of 15 to 90 Shore A.

In one aspect, the base member is formed from an extruded material, such as an extruded metal.

In other aspects, the elastomeric body is formed from two materials, with one of the materials having a different durometer value or different color or texture than the other material. For example, one material may be applied to one portion of the base member, while the other material is applied to another portion of the base member.

In accordance with another aspect, the elastomeric body is molded to the base member.

According to another form of the invention, a compound bow includes a base member with a longitudinal extent and first and second ends. The base member is formed from a rigid material and has a grip location between its first and second ends. The base member further has at least one lightening opening to thereby reduce the weight of the base member. The grip location has at least one mounting opening for mounting a separate grip to the base member. The ends of the base member provide mounting locations for mounting limbs to the base member. An elastomeric body is applied over and at least substantially encapsulates the base member over the base member's longitudinal extent. The elastomeric body terminates around the grip location to thereby expose the grip location and is formed from a dampening material, which extends at least partially into the lightening opening.

In one aspect, the dampening material is applied to at least a portion of at least one of the ends of the base member. In a further aspect, the dampening material is applied to both ends.

According to yet another form of the invention, a compound bow riser is made by forming a base member from a rigid material, which has a longitudinal extent and first and second ends. The base member includes a grip location between the first and second ends and a mounting opening at the grip location. A dampening material is molded over the base member at least along the longitudinal extent to form an elastomeric body, which at least surrounds the grip location and provides dampening of the base member.

In one aspect, the grip location is covered with the elastomeric body, which forms a grip member at the grip location.

In another aspect, the elastomeric body covers the mounting opening. Optionally, an indication of the perimeter of the grip location may be provided wherein a user may cut along the indication to remove the dampening material from the grip location.

Accordingly, the bow of the present invention exhibits improved vibration dampening and generates less noise when impacted by an object.

These and other objects, advantages, purposes, and features of the invention will become more apparent from the study of the following description taken in conjunction with the drawings.

DETAILED DESCRIPTION OF THE PREFERRED EMBODIMENTS

Figure 1:
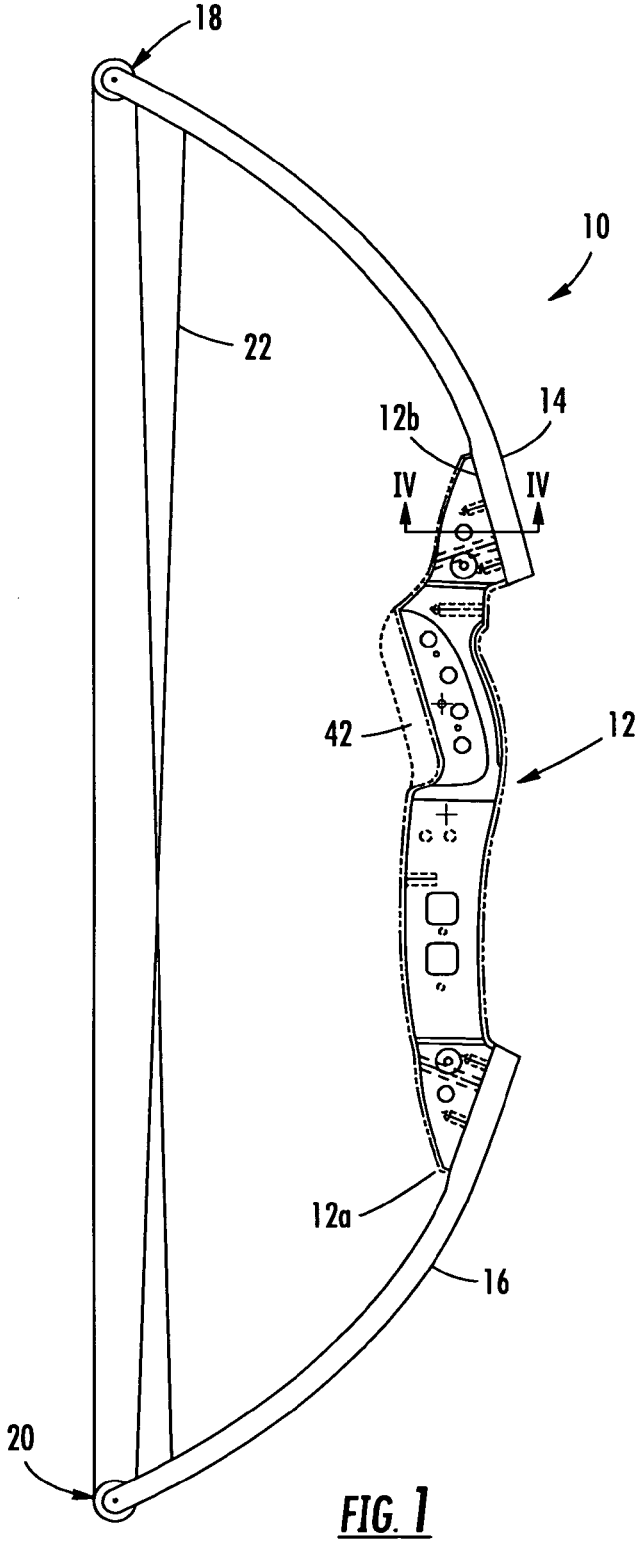
FIG. 1 is a side view of a compound bow embodying the invention.
Figure 4:
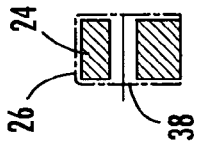
FIG. 4 is a cross-section taken along line IV-IV of FIG. 2.

Referring to FIG. 1, the numeral 10 generally designates a compound bow with a riser 12 of the present invention. As will be more fully described below, riser 12 is configured to dampen and reduce the vibration of bow 10 to thereby reduce the noise generated during a release cycle and, further, to reduce the bow noise when bow 10 is contacted by an object, just as a tree or tree stand or arrow or any other object that may be encountered during hunting.

As best seen in FIG. 1, bow 10 includes riser 12 and two limbs 14 and 16 that are mounted to the opposed ends 12*a* and 12*b* of riser 12 by fasteners. Mounted to the ends of limbs 14 and 16 are pulleys 18 and 20, which support a bow string or cable 22. No further details of the pulleys and cable will be provided herein as they are conventional and well known in the art.

As noted above, bow 10 is adapted to dampen the vibration of the bow during a release cycle and when impacted by an object. For example, when a hunter is using a bow, he or she will sometimes contact the riser with the arrow, which generates noise. Similarly, hunters often climb in trees and, sometimes, sit in a tree stand while waiting for prey. When climbing up or down a tree or when simply moving around a tree, the bow may come in contact with a tree or tree stand. Again, this generates noise, which can scare-off prey.

Figure 2:
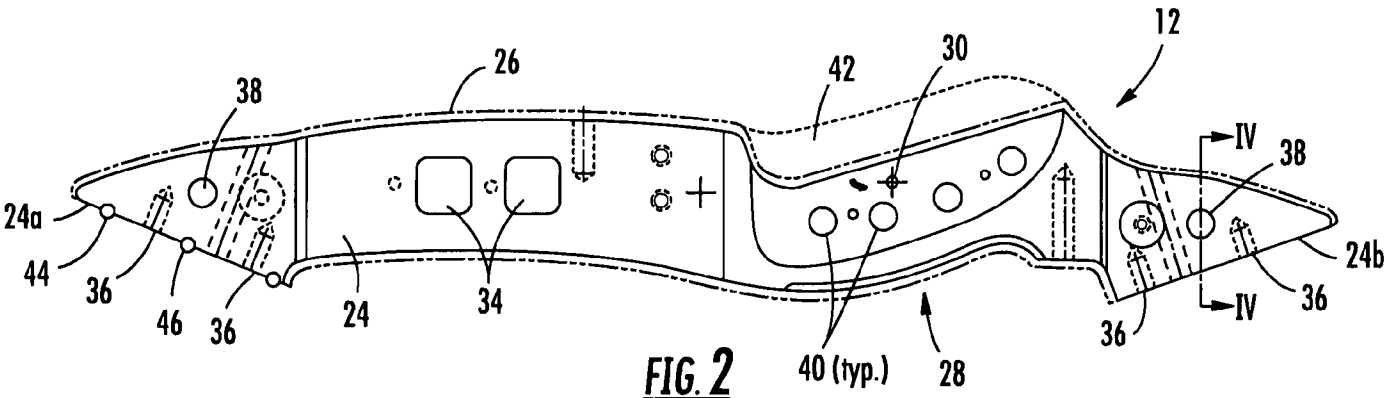
FIG. 2 is an enlarged side view of the riser of FIG. 1.
Figure 3:
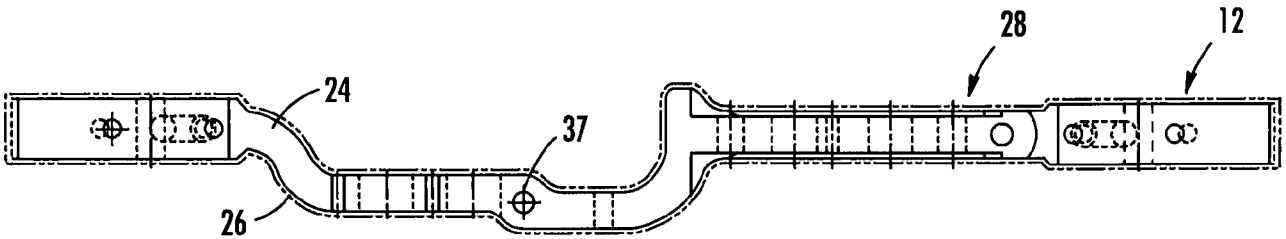
FIG. 3 is a back view of the riser of FIG. 1.

Referring to FIGS. 2 and 3, riser 12 includes a base member 24 and a vibration dampening body 26, which is applied over base member 24. In the illustrated embodiment, base member 24 comprises an extruded member that is formed from a metal, such as aluminum or magnesium; however, it should be understood that the base member may be formed from other materials and, further, may be machined. One suitable base member may be configured and formed using the method described in U.S. Pat. Nos. 5,365,650 and 5,335,644, which are incorporated in their entireties herein.

As best seen in FIG. 2, base member 24 includes a grip area 28 with at least one optional mounting opening 30. Described in further detail below, mounting opening 30 provides a mounting opening for mounting a separate optional grip member to riser 12. In addition to mounting opening 30, base member 24 may include one or more lightening openings 34. Lightening openings 34 may be provided to reduce the weight of base member 24 and, hence, bow 10. Base member 24 also includes a plurality of limb mounting openings 36 at its respective ends 24*a* and 24*b* and a cable guide mounting opening 37. Additional openings that may be provided include tool holes 38 and "AMO" holes 40, which are archery industry standard holes. As would be understood, the number of openings or holes may be varied to suit the particular manufacturer and bow application.

Referring again to FIGS. 2 and 3, body 26 is applied over the full length of base member 24. Body 26 is preferably formed from a dampening material such as an elastomeric material. For example, one suitable material is SANTOPRENE, and may have a durometer in a range of 15 to 90 Shore A. Further, body 26 may be applied to base member 24 using standard over molding techniques. As best seen in FIG. 2, body 26 is applied over grip area 28 and, further, optionally forms a grip member 42. Further, body 26 may be formed from two or more materials, with one material forming grip member 42 and the other material for covering the balance of base member 24. When formed from two or more materials, body 26 may be formed from two shot molding, for example. In this manner, the grip member 42 may be formed from a softer or stiffer material than the material covering the balance of member 24. Further, the two materials forming body 26 may be formed from materials with different colors or different textures or finishes to provide an aesthetic function as well.

As would be understood, therefore, when molding elastomeric body 26 onto base member 24 to form grip member 42, body 26 covers mounting opening 30. Alternately, when forming riser 12 the material forming body 26 may optionally be terminated around grip area 28 so that grip area 28 of base member 24 may be exposed. In this manner, a separate grip member, such as a wood grip or customized grip, may be mounted to riser 12.

Alternately, elastomeric body 26 may be molded over grip area 28 as noted above but formed with a demarcation line or recesses or some sort of indication that provides a guide to allow the elastomeric body to be cut and trimmed to remove that portion of the elastomeric body that forms grip member 42. In this manner, a single riser may be made that can be used in both a standard configuration and a customized configuration.

In addition, elastomeric body 26 may be molded over, for example, lightening openings 34 so that the material forming body 26 either completely fills the lightening openings or only partially fills the openings. Alternately, when over molding base member 24, plugs or spacers may be inserted into the lightening openings so that the elastomeric material partially fills the openings but leaves openings of smaller dimensions than the original lightening openings when the plugs are removed. Alternately, the plugs may fill the entire opening so that the elastomeric material terminates at the edges of the openings. Similarly, cable guide opening 37 may be filled with a plug during molding or the elastomeric material may be trimmed at the opening so that the cable guide may be mounted to riser 12 in a conventional manner.

Referring again to FIG. 2, as noted above elastomeric body 26 is applied over the full length of base member 24.

In the illustrated embodiment, elastomeric body 26 terminates at the ends of base member 24 so that ends 24*a* and 24*b* are exposed. Optionally, as illustrated in reference to end 24*a*, elastomeric member 26 may extend over the ends of member 24. For example, elastomeric body 26 may entirely cover the surfaces of ends 24*a*, 24*b* or cover portions of the surfaces of ends 24*a*, 24*b*. For example, ends 24*a* and 24*b* may include one or more recesses 44 into which the elastomeric material may extend and, further, project to form elastomeric ribs or regions 46 to provide dampening between limbs 14 and 16 and base member 24.

In addition to covering base member 24, the elastomeric material may be applied to portions of or the entire lengths of limbs 14 and 16.

In addition to dampening vibration and reducing noise, body 26 also protects the base member from oxidation. Thus, body 26 eliminates the need for painting base member 24. Further, body 26 may provide a medium for decorating base member 24. For example, as noted, body 26 may be formed from a colored elastomeric material. In addition, decorative patterns or designs or the like may be molded into body 26. For example, emblems can be molded into the outer surface of body 26 or may be embedded onto body 26 either during molding or inserted into recesses molded into body 26.

In addition to dampening vibration and reducing noise, body 26 also provides a barrier that makes riser 12 warmer to the touch. Further, body 26 allows for riser 12 to be formed with a unique and/or customized shape.

Referring to FIGS. 5-8, the numeral 112 designates another embodiment of the riser of the present invention. Similar to riser 12, riser 112 includes a base member 124 and an elastomeric body 126. Body 126 preferably is applied, such as by over molding, to base member 124 to dampen the vibration of riser 112 and reduce the noise of riser 112 when impacted by an object similar to riser 12.

In the illustrated embodiment, grip member 142 is formed from a different elastomeric material than the balance of body 126, which covers the remaining portion of base member 124. Similarly, grip member 142 covers a grip mounting opening 130 formed in base member 124, which allows for another grip member to be mounted to base member 124 after removal of grip member 142.

Figure 5:
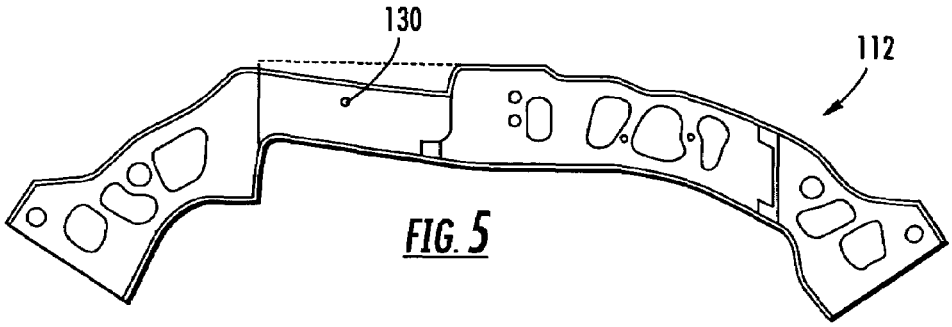
FIG. 5 is a side view of another embodiment of the riser of the present invention.
Figure 6:
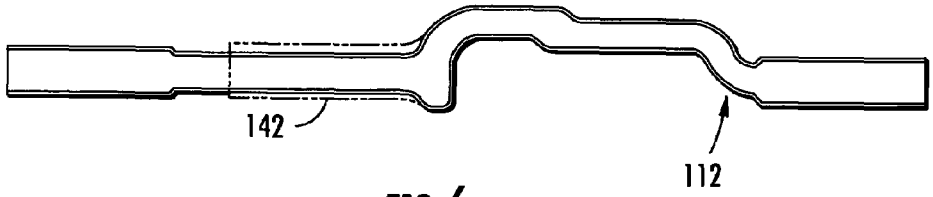
FIG. 6 is a back view of the riser of FIG. 5.
Figure 7:
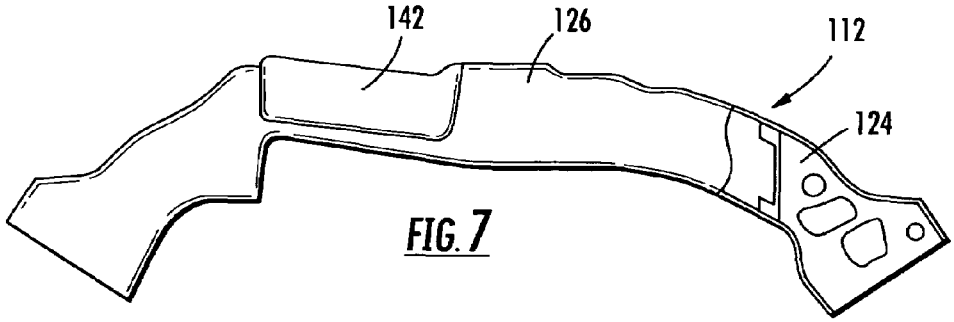
FIG. 7 is a similar view to FIG. 5 illustrating a grip molded onto the riser.
Figure 8:
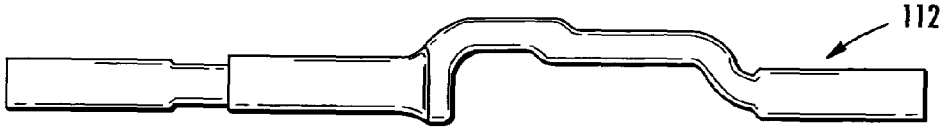
FIG. 8 is a back view of the riser of FIG. 5.

As shown in FIG. 5, base member 124 includes a different arrangement and number of lightening openings 132 as well as AMO holes and tool holes. As noted, the number and location of lightening openings, as well as AMO homes and tool holes, can vary.

Accordingly, the present invention provides a bow that exhibits dampened vibration and, further, generates reduced noise levels when impacted by an object, such as a tree, tree stand, or an arrow. Further, the riser is assembled in a manner that permits further customization of the riser while also providing greater resistance to corrosion.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

The embodiments of the invention in which an exclusive property right or privilege is claimed are defined as follows:

1. A compound bow comprising:

a base member, said base member having a longitudinal extent and having first and second ends, said base member being formed from a rigid material and having a grip location between said first and second ends, said first end providing a first mounting location for mounting a first limb to said base member at said first end, and said second end providing a second location for mounting a second limb to said base member at said second end; and a dampening body applied over and at least substantially encapsulating said base member over said longitudinal extent, said dampening body comprising a dampening material, and said dampening body forming a grip member at said grip portion wherein said base member includes at least one mounting opening at said grip location for mounting a separate grip to said base member, said dampening body being applied over said mounting opening but being removable wherein the separate grip may be mounted to said base member at said mounting opening in place of said grip formed by said dampening body.

2. The bow according to claim 1, wherein said base member is formed from an extruded material.

3. The bow according to claim 1, wherein said dampening material comprises first and second dampening materials, said first dampening material having a different durometer value than said second dampening material, and said first dampening material forming said grip member.

4. The bow according to claim 1 in combination with a first limb mounted at said first mounting location, and a second limb mounted at said second mounting location.

5. The bow according to claim 4 wherein said dampening material is applied over at least a portion of each of said limbs.

6. The bow according to claim 1, wherein said dampening material is applied to at least a portion of at least one of said ends.

7. The bow according to claim 6, wherein said at least one of said ends includes at least one recess, said dampening material extending into said recess.

8. The bow according to claim 1 wherein said dampening body terminates at said ends.

9. The bow according to claim 8 wherein said ends of said base member are free of said dampening material.

10. The bow according to claim 1, wherein said dampening body has an indication around said grip location to provide a cutting guide for a user to cut and remove said dampening material around said grip location.

11. The bow according to claim 1, wherein said dampening material comprises an elastomeric material.

12. A compound bow comprising:

a base member, said base member having a longitudinal extent and having first and second ends, said base member being formed from a rigid material and having a grip location between said first and second ends, said first end providing a first mounting location for mounting a first limb to said base member at said first end, and said second end providing a second location for mounting a second limb to said base member at said second end; and a dampening body applied over and at least substantially encapsulating said base member over said longitudinal extent, said dampening body comprising a dampening material, and said dampening body forming a grip member at said grip portion wherein said dampening body has an indication around said grip location to provide a cutting guide for a user to cut and remove said dampening material around said grip location.

13. The bow according to claim 12, wherein said dampening material comprises an elastomeric material.

14. A compound bow comprising:

a base member, said base member having a longitudinal extent and having first and second ends, said base member being formed from a rigid material and having a grip location between said first and second ends, said grip location having at least one mounting opening for mounting a separate grip to said base member, said first end providing a first mounting location for mounting a first limb to said base member at the first end, and said second end providing a second location for mounting a second limb to said base member at said second end; and an elastomeric body being applied over and at least substantially encapsulating said base member over said longitudinal extent, said elastomeric body covering said mounting opening but being removable at least at said mounting opening, and said elastomeric body being formed from an elastomeric material.

15. The bow according to claim 14, wherein said base member is formed from an extruded material.

16. The bow according to claim 14, wherein said elastomeric body is formed from first and second elastomeric materials, said first elastomeric material having different durometer value than said second elastomeric material, and said first elastomeric material applied to one portion of said base member, and said second elastomeric material being applied to a second portion of said base member.

17. The bow according to claim 14 in combination with a first limb mounted at said first mounting location, and a second limb mounted at said second mounting location.

18. The bow according to claim 14, wherein said elastomeric material is applied to at least a portion of at least one of said ends.

19. The bow according to claim 18, wherein said at least one of said ends includes recesses, said elastomeric material extending into said recess.

20. The bow according to claim 14, wherein said elastomeric body is molded to said base member.

21. A compound bow comprising:

a base member, said base member having a longitudinal extent and having first and second ends, said base member being formed from a rigid material and having a grip location between said first and second ends, said base member further having at least one lightening opening to thereby reduce the weight of said base member, said grip location having at least one mounting opening for mounting a separate grip to said base member, said first end providing a first mounting location for mounting a first limb to said base member at said first end, and the second end providing a second location for mounting a second limb to said base member at said second end; and a dampening body being applied over and at least substantially encapsulating said base member over said longitudinal extent, said dampening body terminating around said grip location to thereby expose said grip location, said dampening body being formed from an elastomeric material, and said elastomeric material extending at least partially into the lightening opening.

22. The bow according to claim 21 in combination with a first limb mounted at said first mounting location, and a second limb mounted at said second mounting location.

23. The bow according to claim 21, wherein said elastomeric material is applied to at least a portion of at least one of said ends.

24. The bow according to claim 23, wherein said elastomeric material is applied to both of said ends.

* * * * *